US007105760B2

(12) United States Patent
Zensai

(10) Patent No.: US 7,105,760 B2
(45) Date of Patent: Sep. 12, 2006

(54) OPERATION BUTTON MOUNTING STRUCTURE, AND IMAGE FORMING APPARATUS AND ELECTRONIC APPARATUS EQUIPPED WITH THE SAME

(75) Inventor: Atsunori Zensai, Daito (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 11/344,151

(22) Filed: Feb. 1, 2006

(65) Prior Publication Data

US 2006/0180454 A1 Aug. 17, 2006

(30) Foreign Application Priority Data

Feb. 2, 2005 (JP) ..... 2005-025906

(51) Int. Cl.
*H01H 13/14* (2006.01)

(52) U.S. Cl. ..... 200/341; 200/314; 200/293

(58) Field of Classification Search ..... 200/341, 200/293–296, 310–314, 520
See application file for complete search history.

(56) References Cited

U.S. PATENT DOCUMENTS 4,816,630 A * 3/1989 Honda et al. ..... 200/314
5,399,820 A * 3/1995 Silfvast ..... 200/314
5,878,870 A * 3/1999 Ohtaki ..... 200/314
6,384,355 B1 * 5/2002 Murphy et al. ..... 200/344
6,590,174 B1 * 7/2003 Zysnarski et al. ..... 200/310
6,747,226 B1 * 6/2004 Watanabe ..... 200/520

FOREIGN PATENT DOCUMENTS

JP 63-55344 U 4/1988
JP 2-145738 U 12/1990
JP 7-141961 A 6/1995

* cited by examiner

*Primary Examiner*—Kyung Lee
(74) *Attorney, Agent, or Firm*—Crowell & Moring LLP

(57) ABSTRACT

An image forming apparatus includes a button member having an operation button portion, a part of which is translucent, an LED arranged behind the operation button portion, a switch arranged behind the button member and a button supporting member, which supports the button member rotatably. The button member is rotatably supported by a shaft portion provided at the button supporting member and the operation button portion is pressed by a plate spring portion out of the image forming apparatus. When the operation button portion is pressed against the pressing force of the plate spring portion, a button contact portion provided at a front end of the plate spring portion allows the switch to operate. In this configuration, the shaft portion, the plate spring portion, the button contact portion, the switch and the LED are arranged so as to overlap the button member for simplification.

11 Claims, 5 Drawing Sheets

OPERATION BUTTON MOUNTING STRUCTURE, AND IMAGE FORMING APPARATUS AND ELECTRONIC APPARATUS EQUIPPED WITH THE SAME

BACKGROUND OF THE INVENTION

1. Field of the Invention

The present invention relates to an operation button mounting structure, and an image forming apparatus and an electronic apparatus equipped with the operation button attachment structure.

2. Description of the Related Art

Conventionally, various attempts have been made for simplification of an assembling process of a button member having an operation button operated for inputting various commands to an electronic device. For example, Japanese Laid-Open Patent Publication No. 7-141961 discloses an attachment structure which enables simplification of attachment of a button member by engaging a hook provided at the button member with an engaging portion of a housing thereof. Furthermore, Japanese Laid-Open Utility Model Publication No. 63-55344 discloses a structure in which a hinge is provided at a button member and the hinge is fixed by being held between a chassis and base board. Still furthermore, Japanese Laid-Open Utility Model Publication discloses a structure in which a button member is supported by an upper arm and lower arm.

In recent electronic apparatuses, for the facilitation of its operation, a part of an operation button which is to be operated by a user is made translucent, a light emitting device provided on a rear face side of the operation button emits light and the light passes through the translucent region to allow the operation button to glow, thereby prompting the user to operate the operation button. In such electronic apparatuses, since the light emitting device and a switch are provided on the rear face side of the operation button, the configuration of the operation button structure becomes complicated and thus an assembling process thereof also becomes complicated. Moreover, this is a cause for disturbing the downsizing of the electronic apparatus.

SUMMARY OF THE INVENTION

In order to solve the above-mentioned problem, the present invention intends to provide an operation button attachment structure with a simple configuration by which cost reduction and downsizing of an electronic apparatus can be realized even when a light emitting device and a switch are provided on a rear face side of the operation button, and to provide an image forming apparatus and an electronic apparatus equipped with the attachment structure.

An operation button attachment structure in one aspect of the present invention comprises: a button member having an operation button portion operated by a user, at least a part of the operation button portion having translucency; a light emitting device for emitting light to prompt the operation of the operation button portion, the light emitting device being arranged behind the operation button portion of the button member; and a switch which is arranged behind the button member and turned on or off by the operation of the operation button portion.

A button support member which rotatably supports the button member at its one end remote from the operation button portion is further provided. The button support member has a shaft portion for pivotally supporting an end portion of the button member and a plate spring portion which contacts with a rear face of the button member between one end of the button member pivotally supported by the shaft portion and the operation button portion and presses the button member. The plate spring portion has a button contact portion which contacts with the button member at its front end. The switch is arranged behind the button contact portion. When the operation button portion is operated against a pressing force of the plate spring portion, the switch is turned on or off through the button contact portion and the shaft portion, the plate spring portion, the button contact portion, the switch and the light emitting device are arranged so as to overlap the button member.

In such configuration, the shaft portion, the button contact portion, the switch and the light emitting device can be arranged so as to overlap the button member. In other words, the shaft portion, the button contact portion, the switch and the light emitting device can be put together on a plane on which the button member rotates. Thus, the operation button attachment structure can be simplified, thereby enabling cost reduction and downsizing of an electronic apparatus such as an image forming apparatus. Furthermore, since the switch is arranged between the shaft portion as a rotational shaft of the button member and the operation button portion, the switch can be operated only when the operation button portion is operated in a longer stroke than a stroke required for turning on or off the switch. Thus, even when a part of the user's body touches the operation button portion lightly, the switch can be prevented from operating contrary to the user's intention.

DETAILED DESCRIPTION OF THE EMBODIMENT

Figure 1:
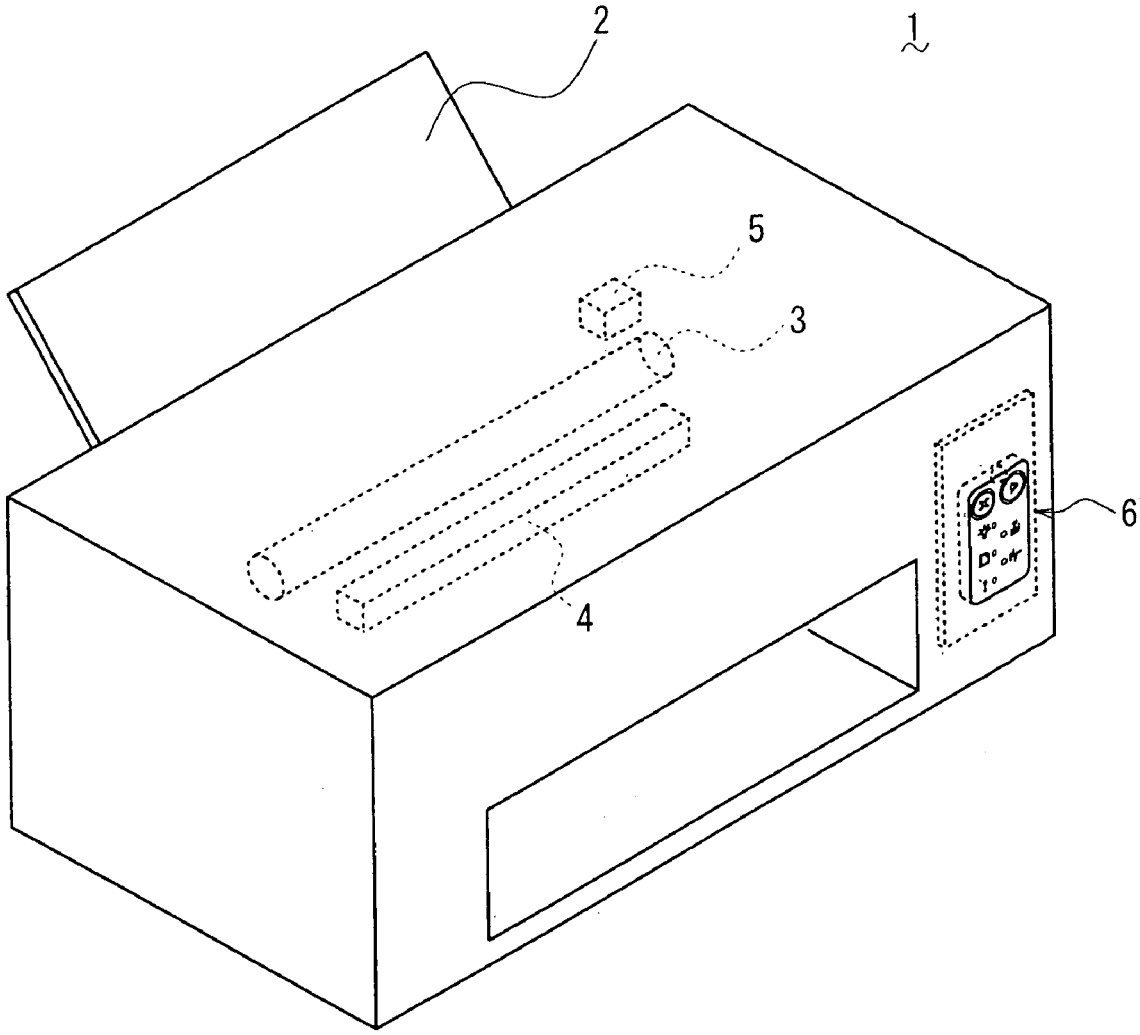
FIG. 1 is a perspective view showing a configuration of an image forming apparatus in accordance with an embodiment of the present invention.

An image forming apparatus in accordance with an embodiment of the present invention is described with reference to figures. FIG. 1 shows a schematic configuration of the image forming apparatus.

The image forming apparatus 1 comprises a paper feed tray 2 for holding loaded recording paper sheets thereon, a conveying roller (recording paper conveying means) 3 for conveying the recording paper sheet held on the paper feed tray 2 along a predetermined conveying path, an image forming unit (image forming means) 4 for forming an image on the recording paper sheet conveyed by the conveying roller 3, a paper jam detector (paper jamming detecting means) 5 for detecting jam of the recording paper sheet in the conveying path and a indication unit 6 for indicating an operation state of the image forming apparatus 1 thereon.

Figure 2:
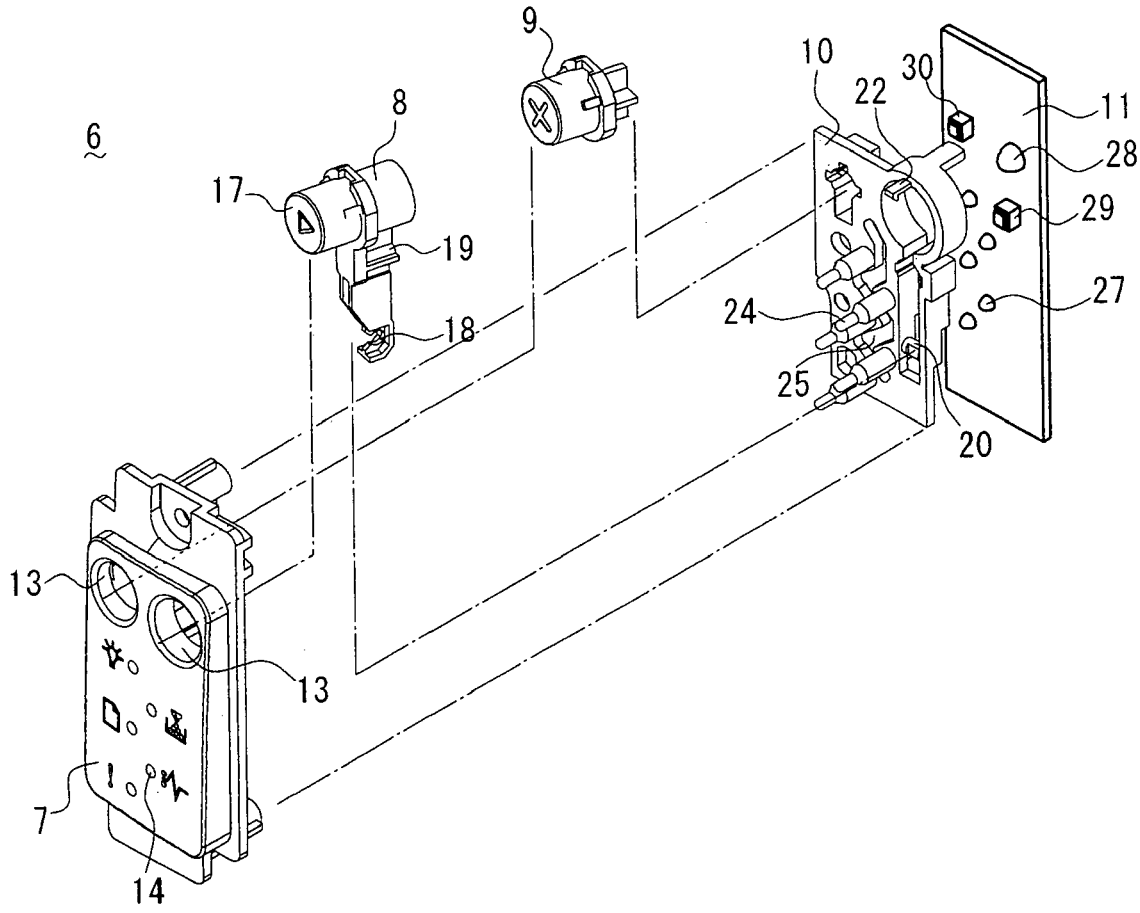
FIG. 2 is a perspective view showing a configuration of an indication unit of the image forming apparatus.
Figure 3:
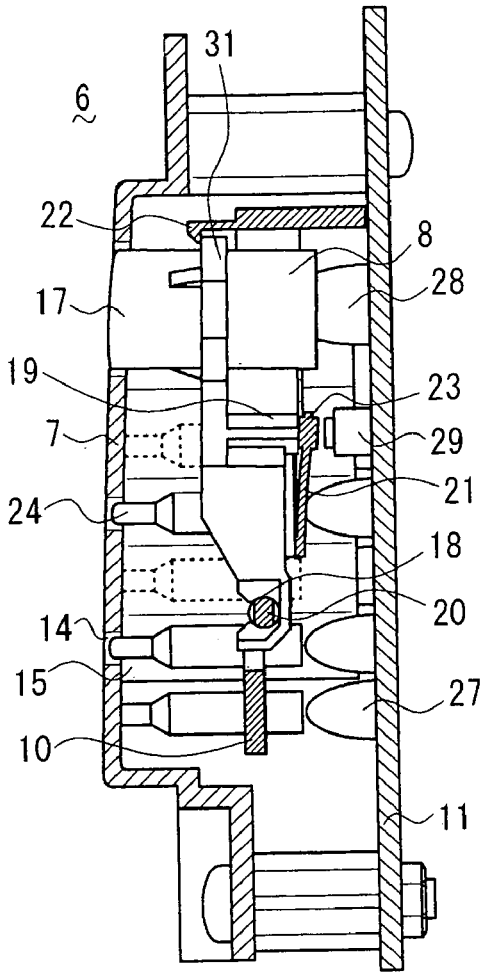
FIG. 3 is a side sectional view showing the configuration of the indication unit.

FIGS. 2 and 3 respectively show a configuration of the indication unit 6. The indication unit 6 has an indication panel 7 arranged on a front face or a top face of the image forming apparatus 1, button members 8 and 9 operated by a user, button supporting member 10 for supporting the button members 8 and 9, and circuit board 11 for mounting various kinds of electronic components forming the indication unit 6 thereon.

The indication panel 7 has circular openings 13 which face operation button portions 17 of the button members 8 and 9, through holes 14 which face a plurality of light guiding portions 24 formed on the button supporting member 10, and a light shielding board 15 for shielding light so that the light emitted from a plurality of LEDs 27 mounted on the circuit board 11 may not be entered into the adjacent light guiding portions 24. The through holes 14 are arranged in a staggered manner, and a mark representing an operation state of the image forming apparatus 1 is formed in a periphery of each through holes 14. The light shielding board 15 is formed on an inner face side of the indication panel 7 in a zigzag fashion so as to intervene between adjacent through holes 14.

The button member 8 is pivotally supported by a shaft portion 20 of the button supporting member 10 at its one end and the button member 8 rotates in response to the pressure of the operation button portion 17, thereby turning on or off a switch 29 provided on the circuit board 11. The button member 8 is formed of a resin material having translucency and allows light emitted from an LED (light emitting device) 28 mounted on the circuit board 11 to pass through the image forming apparatus 1 to prompt the user to perform an operation.

The button member 8 has the operation button portion 17 which is shaped like an arm and pressed by the user, a notched portion 18 formed so as to engage with the shaft portion 20 of the button supporting member 10 at its one end remote from the operation button portion 17 and a spring contact portion 19 which contacts with a plate spring portion 21 of the button supporting member 10 between the operation button portion 17 and the notched portion 18.

A light shielding seal is partially stuck on the operation button portion 17 by hot stamping or the like. When the LED 28 lights up, light emitted from the LED 28 penetrates from the area on which the seal is not stuck, so that it seems to the user as if the operation button portion 17 itself lights up. Thus, the user is prompted to operate the operation button portion 17 so that a necessary operation can be performed certainly. More specifically, the operation button portion 17 has a function of inputting a command to restart the conveyance of the recording paper sheet and the formation of an image after the recording paper jammed in the conveying path is removed by the user, and a seal for making the user visually recognize the function is stuck to the operation button portion 17.

The notched portion 18 is formed to be opened in a direction (upward direction in FIG. 3) opposite to the direction in which the operation button portion 17 is pressed. By forming the notched portion 18 in such shape, even when the operation button portion 17 is pressed too much and the button member 8 is to rotate about the button contact portion 23 contacting with the switch 29, the engagement of the notched portion 18 with the shaft portion 20 cannot be removed.

Figure 4:
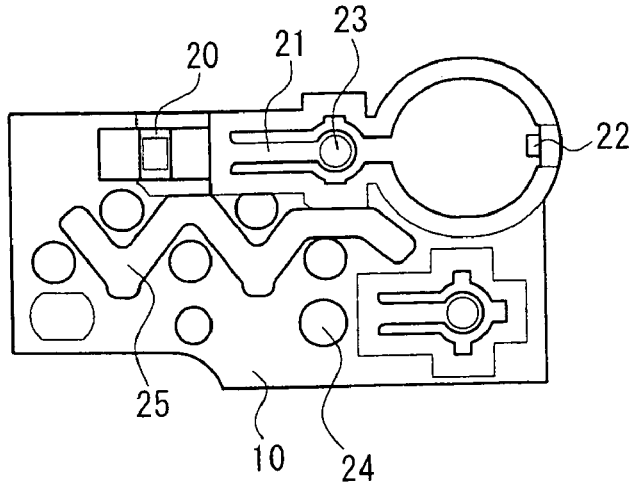
FIG. 4 is a rear view of a button supporting member applied to the indication unit.

FIG. 4 is a rear view of the button supporting member 10. The button supporting member 10 is formed of a resin material having translucency and has the shaft portion 20 for pivotally supporting an end portion of the button member 8, the plate spring portion 21 which contacts with the rear face of the button member 8 and presses the button member 8 in the outward direction of the image forming apparatus 1, and an button engaging portion 22 which engages with the vicinity of the operation button portion 17 and holds the button member 8 pressed by the plate spring portion 21. The plate spring portion 21 is extended in the direction perpendicular to the shaft portion 20 from the vicinity of the shaft portion 20 and has a button contact portion 23 which contacts with the button member 8 at its front end.

The button supporting member 10 has a plurality of light guiding portions 24 for guiding light emitted from a plurality of LEDs mounted on the circuit board 11 at a location adjacent to the button member 8 supported by the shaft portion 20 and a light shielding board inserting groove 25 into which the light shielding board 15 is inserted formed on the indication panel 7 (refer to FIG. 4). The light guiding portions 24 are arranged in a staggered manner so as to correspond to the through holes 14.

The LEDs 27 arranged to face rear faces of the light guiding portions 24, the LED 28 arranged to face the rear face of the operation button portion 17, a switch 29 arranged to face a rear face of the button contact portion 23 of the button supporting member 10 and a switch 30 arranged to face a rear face of the button member 9 are mounted on the circuit board 11, as shown in FIG. 2.

The button member 8 is attached to the button supporting member 10 as follows. First, the notched portion 18 formed substantially circular at one end of the button member 8 is engaged with the shaft portion 20, and the button member 8 is rotated in clockwise direction in FIG. 3. Thereby, the spring contact portion 19 of the button member 8 contacts with the button contact portion 23 of the button supporting member 10, so that the plate spring portion 21 generates a pressing force to push the operation button portion 17 out of the indication panel 7. At this time, by further rotating the button member 8 against the pressing force of the plate spring portion 21 while deforming the button engaging portion 22 in the direction separating from the shaft portion 20, a front end 31 of the button member 8 engages with the button engaging portion 22 so that the attachment of the button member 8 is completed as shown in FIG. 3.

When the operation button portion 17 is pressed inward of the image forming apparatus 1 by the user from the state as shown in FIG. 3, a rear face of the button contact portion 23 contacts with the switch 29 while the plate spring portion 21 is further bent, and thereby, the switch 29 is operated. When inputting of an operating command is finished and the user's finger or the like separates from the operation button portion 17, the button member 8 rotates in counterclockwise direction due to the pressing force of the plate spring portion 21 in FIG. 3, and the rear face of the button contact portion 23 separates from the switch 29 to return to the state shown in FIG. 3.

As described above, in the image forming apparatus 1 in this embodiment, the shaft portion 20, the plate spring portion 21, the button contact portion 23, the switch 29, the LED 28 and the button engaging portion 22 can be arranged so as to overlap the button member 8 when viewed from the outside of the image forming apparatus 1. In other words, the shaft portion 20, the plate spring portion 21, the button contact portion 23, the switch 29, the LED 28 and the button engaging portion 22 can be put together on a plane on which the button member 8 rotates. Thus, the operation button attachment structure is simplified, so that cost reduction and downsizing of the image forming apparatus 1 can be realized.

Furthermore, since the switch 29 is arranged between the shaft portion 20 as a rotation shaft of the button member 8 and the operation button portion 17, the switch 29 can be operated only when the operation button portion 17 is operated in a longer stroke than a stroke required for turning on or off the switch 29. Thus, the switch 29 operates only when the user pushes in the operation button portion 17 definitely and the switch 29 does not respond with the extent that a part of the user's body touches the operation button portion 17 lightly. Thus, it is possible to prevent erroneous operation of the switch 29 contrary to the user's intention.

Still furthermore, since the plate spring portion 21 is extended in the direction perpendicular to the shaft portion 20 from the vicinity of the shaft portion 20, the trajectory of the button contact portion 23 while the button member 8 is rotated substantially coincides with that of the spring contact portion 19 of the button member 8. Thus, unnecessary torsion moment is not applied to the button member 8 and the plate spring portion 21, so that breakage of the button member 8 and the plate spring portion 21 and wear of the shaft portion 20 and the button contact portion 23 can be prevented. Still furthermore, since the button engaging portion 22 provided on the button supporting member 10 engages with the front end 31 of button member 8 to hold the button member 8 pressed by the plate spring portion 21, the operation button portion 17 does not project from the image forming apparatus 1 more than necessary, thereby improving design of the appearance of the device 1.

Figure 5:
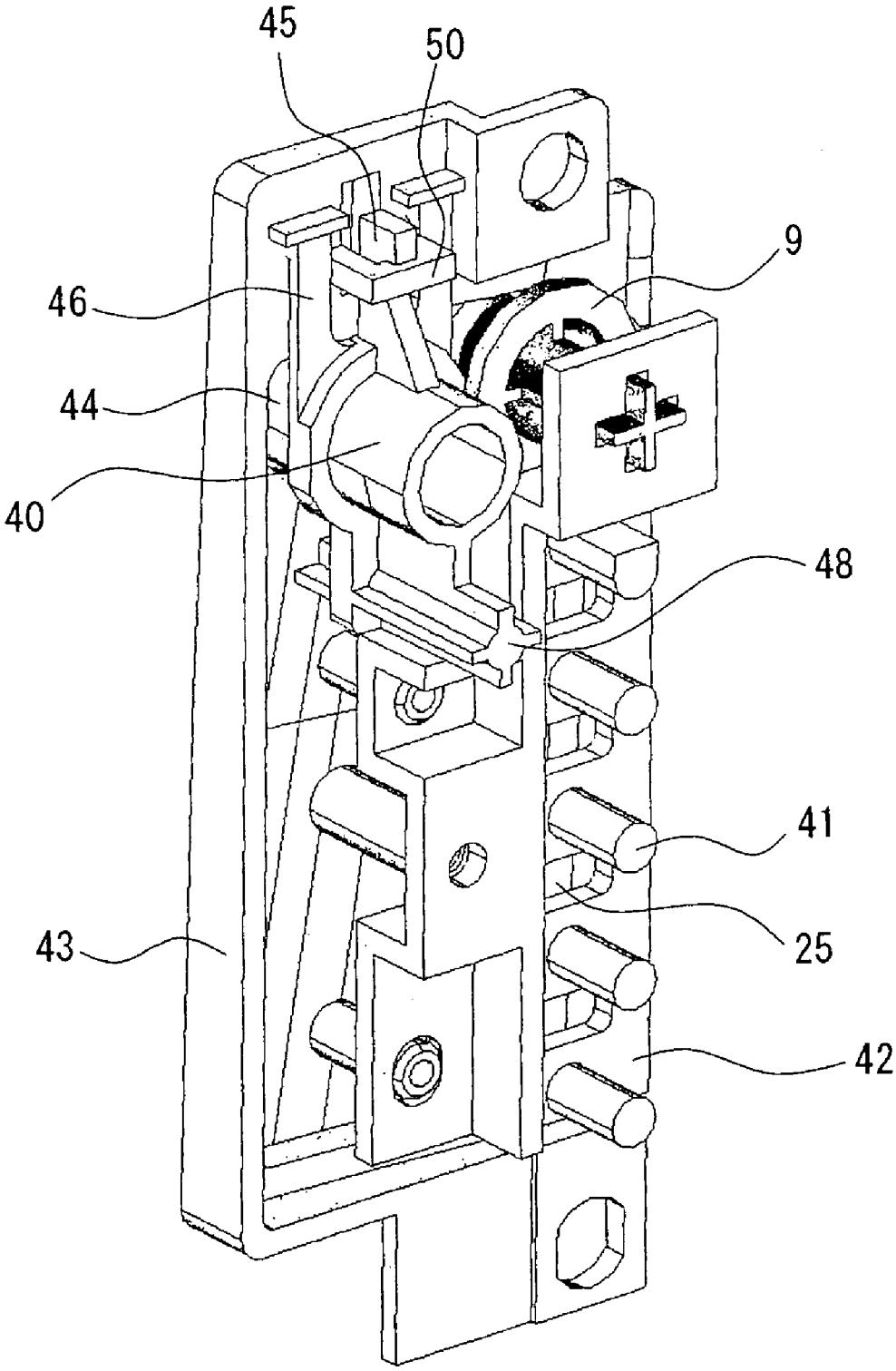
FIG. 5 is an assembly perspective view showing another configuration of the indication unit of the image forming apparatus.
Figure 6:
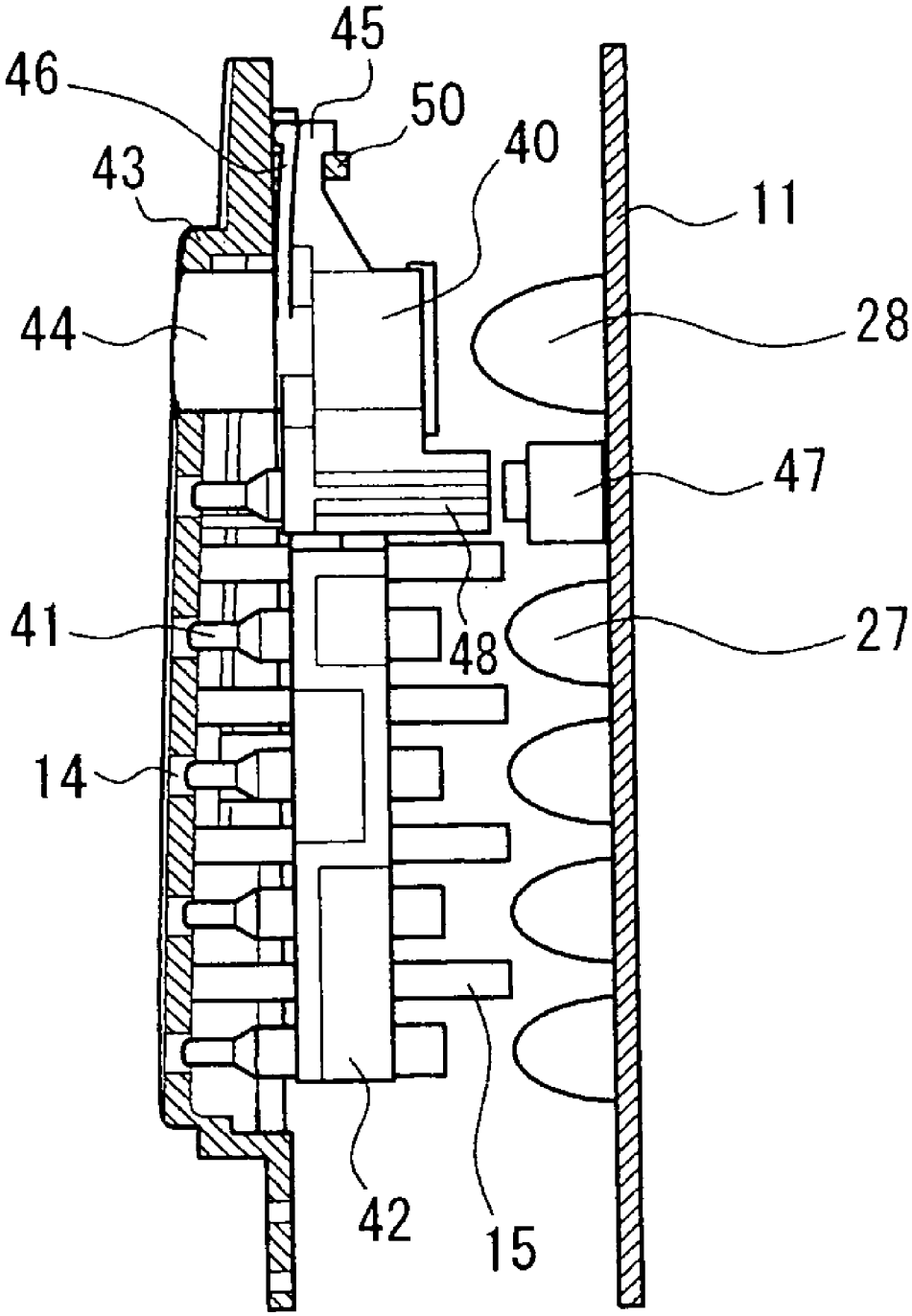
FIG. 6 is a side sectional view showing another configuration of the indication unit.

The present invention is not limited to the configuration of the above-mentioned embodiment and it is only needed that the shaft portion 20 and the plate spring portion 21 are formed on the button supporting member 10 and the switch 29 is operated by the button contact portion 23 of the plate spring portion 21. Furthermore, the present invention can be modified in various manners, and it may be an operation button attachment structure shown in FIGS. 5 and 6, for example. In such a configuration, a button member 40 formed of a material having translucency is directly attached to the indication panel 43 without interposing a light guiding member 42 with a plurality of light guiding portions 41. The button member 40 has a notched engaging portion 45 and a plate spring portion 46 on one end thereof and a switch contact portion 48 for turning on or off a switch 47 on the other end thereof across an operation button portion 44. A button supporting portion 50, which engages with the notched engaging portion 45 and rotatably supports the button member 40, is provided on the indication panel 43. When the operation button portion 44 is pressed, the button member 40 rotates and the switch contact portion 48 contacts with the switch 47, and thereby the switch 47 is turned on or off. Also in the operation button attachment structure, since the LED 28 and the switch 47 can be put together in the vicinity of the button member 40, costs can be reduced with the simple configuration. In FIGS. 5 and 6, portions having the same functions as those in FIG. 3 have been given the same reference numerals and description thereof is omitted. Furthermore, any of the above-mentioned operation button attachment structures can be widely applied to electronic apparatus.

This application is based on Japanese patent application 2005-25906 filed Feb. 2, 2005 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An operation button attachment structure comprising: a button member having an operation button portion operated by a user, at least a part of the operation button portion having translucency; a light emitting device for emitting light to prompt the operation of the operation button portion, the light emitting device being arranged behind the operation button portion of the button member; and a switch which is arranged behind the button member and turned on or off by the operation of the operation button portion, wherein a button support member which rotatably supports the button member at its one end remote from the operation button portion is further provided;

the button support member has a shaft portion for pivotally supporting an end portion of the button member and a plate spring portion which contacts with a rear face of the button member between one end of the button member pivotally supported by the shaft portion and the operation button portion and presses the button member;

the plate spring portion has a button contact portion which contacts with the button member at its front end;

the switch is arranged behind the button contact portion; and when the operation button portion is operated against a pressing force of the plate spring portion, the switch is turned on or off through the button contact portion and the shaft portion, the plate spring portion, the button contact portion, the switch and the light emitting device are arranged so as to overlap the button member.

2. The operation button attachment structure in accordance with claim 1, wherein the button member is formed of a resin material having translucency and further has an operation button portion which is shaped like an arm and pressed by the user, a notched portion formed so as to engage with the shaft portion of the button supporting member at its one end remote from the operation button portion and a spring contact portion which contacts with a plate spring portion of the button supporting member between the operation button portion and the notched portion.

3. The operation button attachment structure in accordance with claim 2, wherein a light shielding seal is partially stuck on the operation button portion.

4. The operation button attachment structure in accordance with claim 1, wherein the operation button attachment structure is used in an indication panel of an electronic apparatus.

5. The operation button attachment structure in accordance with claim 4, wherein the electronic apparatus is an image forming apparatus;

the indication panel is used for inputting a command to restart conveyance of a recording paper sheet and formation of an image after the recording paper jammed in a conveying path is removed by the user; and a seal for making the user visually recognize a function is stuck to the operation button portion.

6. An image forming apparatus comprising: a paper feed tray for holding loaded recording paper sheets thereon; a recording paper conveying means for conveying a recording paper sheet held on the paper feed tray along a predetermined conveying path; an image forming means for forming an image on the recording paper sheet conveyed by the conveying roller, a paper jam detecting means for detecting jam of the recording paper sheet on the conveying path; a paper jam informing means for informing to a user of the recording paper jam detected by the paper jam detecting means; a button member having an operation button portion operated by the user to restart conveyance of the recording paper sheet and formation of the image, at least a part of the operation button portion having translucency; a light emitting device for emitting light to prompt the operation of the operation button portion, the light emitting device being arranged behind the operation button portion of the button member; and a switch which is arranged behind the button member and turned on or off by the operation of the operation button portion, wherein a button support member which rotatably supports the button member at its one end remote from the operation button portion is further provided;

the button support member has a shaft portion for pivotally supporting an end portion of the button member, a plate spring portion which contacts with a rear face of the button member between one end of the button member pivotally supported by the shaft portion and the operation button portion and presses the button member in an outward direction of the image forming apparatus, and an button engaging portion which engages with a vicinity of the operation button portion and holds the button member pressed by the plate spring portion;

the plate spring portion is extended in a direction perpendicular to the shaft portion from a vicinity of the shaft portion and has a button contact portion which contacts with the button member at its front end;

the switch is arranged behind the button contact portion; and when the operation button portion is operated against a pressing force of the plate spring portion, the switch is turned on or off through the button contact portion, and the shaft portion, the plate spring portion, the button contact portion, the switch and the light emitting device are arranged so as to overlap the button member viewed from the outside of the image forming apparatus so that the image forming apparatus can be downsized.

7. An electronic apparatus equipped with an operation button attachment structure, wherein the operation button attachment structure comprising: a button member having an operation button portion operated by a user, at least a part of the operation button portion having translucency; a light emitting device for emitting light to prompt the operation of the operation button portion, the light emitting device being arranged behind the operation button portion of the button member; and a switch which is arranged behind the button member and turned on or off by the operation of the operation button portion;

a button support member which rotatably supports the button member at its one end remote from the operation button portion is further provided;

the button support member has a shaft portion for pivotally supporting an end portion of the button member and a plate spring portion which contacts with a rear face of the button member between one end of the button member pivotally supported by the shaft portion and the operation button portion and presses the button member;

the plate spring portion has a button contact portion which contacts with the button member at its front end;

the switch is arranged behind the button contact portion; and when the operation button portion is operated against a pressing force of the plate spring portion, the switch is turned on or off through the button contact portion and the shaft portion, the plate spring portion, the button contact portion, the switch and the light emitting device are arranged so as to overlap the button member viewed from the outside of the image forming apparatus so that the operation button attachment structure can be downsized.

8. The electronic apparatus in accordance with claim 7, wherein the button member is formed of a resin material having translucency and further has an operation button portion which is shaped like an arm and pressed by the user, a notched portion formed so as to engage with the shaft portion of the button supporting member at its one end remote from the operation button portion and a spring contact portion which contacts with a plate spring portion of the button supporting member between the operation button portion and the notched portion.

9. The electronic apparatus in accordance with claim 8, wherein a light shielding seal is partially stuck on the operation button portion.

10. The electronic apparatus in accordance with claim 7, wherein the operation button attachment structure is used in an indication panel of the electronic apparatus.

11. The electronic apparatus in accordance with claim 10, wherein the electronic apparatus is an image forming apparatus;

the indication panel is used for inputting a command to restart conveyance of a recording paper sheet and formation of an image after the recording paper jammed in a conveying path is removed by the user; and a seal for making the user visually recognize a function is stuck to the operation button portion.

* * * * *